United States Patent [19]

Strydom

[11] Patent Number: 4,912,877

[45] Date of Patent: Apr. 3, 1990

[54] SECURITY DOOR

[76] Inventor: Nicolaas J. H. Strydom, No 1 Salamanca, Rooigras Street, Waterkloof Glen, Pretoria, Transvaal, South Africa

[21] Appl. No.: 312,112

[22] Filed: Feb. 17, 1989

[30] Foreign Application Priority Data

Feb. 19, 1988 [ZA] South Africa ..... 88/1186

[51] Int. Cl.[4] ..... E06B 7/28

[52] U.S. Cl. ..... 49/171; 49/62

[58] Field of Search ..... 49/171, 170, 169, 62

[56] References Cited

U.S. PATENT DOCUMENTS

| | | | |
|---|---|---|---|
| 1,100,564 | 6/1914 | Heryford | 49/169 X |
| 1,580,826 | 4/1926 | Haenssler | 49/171 X |
| 1,859,974 | 5/1932 | Kroenke | 49/169 X |
| 2,568,130 | 9/1951 | Olson | 49/62 |
| 3,895,669 | 7/1975 | Heeling | 49/171 X |
| 4,592,167 | 6/1986 | Andrawos | 49/171 |

FOREIGN PATENT DOCUMENTS

| | | |
|---|---|---|
| 693236 | 6/1970 | South Africa . |
| 708245 | 3/1971 | South Africa . |
| 734005 | 4/1973 | South Africa . |
| 781754 | 3/1978 | South Africa . |
| 796146 | 9/1980 | South Africa . |

*Primary Examiner*—Philip C. Kannan

*Attorney, Agent, or Firm*—Welsh & Katz, Ltd.

[57] ABSTRACT

A security door comprises an outer frame for closing off a doorway and door hinge means connected to the outer frame for hingedly mounting the outer frame in the doorway. An opening is provided through the outer frame and a plurality of security bars are mounted on the outer frame and extend across the opening. A closure member for closing off the opening is provided, closure member hinge means being connected to the closure member whereby the closure member is pivotally mounted on the outer frame. An insert is provided by the closure member, which insert projects into the opening in the outer frame and occupies said opening when the closure member is in its closed condition, the insert having a plurality of recesses in the form of elongate grooves for respectively receiving the security bars when the closure member is in its closed condition with the bars at least partially enclosed and concealed therein. Lockable door latch means for locking the outer frame in its closed condition to the doorway, and lockable closure member latch means for locking the closure member in its closed condition to the outer frame, are provided.

7 Claims, 2 Drawing Sheets

SECURITY DOOR

According to one aspect of the invention there is provided a security door for closing a doorway into an area protected by the door on the inside of the doorway, the door comprising an outer frame for closing off the doorway;

door hinge means connected to the outer frame for hingedly mounting the outer frame in the doorway, whereby the door can be pivoted between open and closed conditions;

an opening through the outer frame for permitting ventilation and viewing between the area protected by the door and the area outside of the doorway;

a plurality of security bars mounted on the outer frame and extending across the opening to close off the opening to human entry through the opening while permitting said ventilation and viewing;

a closure member for closing off the opening to prevent said ventilation and viewing;

closure member hinge means connected to the closure member whereby the closure member is pivotally mounted on the outer frame and which permits the closure member to be pivoted into the area protected by the door from a closed condition in which it closes off the opening to assume an open condition in which it permits said ventilation and viewing, and to be pivoted from said open condition into said closed condition;

an insert for the opening which insert is provided by the closure member and which insert projects into the opening in the outer frame and occupies said opening when the closure member is in its closed condition;

a plurality of recesses in the form of elongate grooves in the insert for respectively receiving the security bars when the closure member is in its closed condition with the bars at-least partially enclosed and concealed therein;

lockable door latch means for locking the outer frame in its closed condition to the doorway; and lockable closure member latch means for locking the closure member in its closed condition to the outer frame.

The opening may be rectangular, said insert being in the form of a rectangular panel having an outer periphery of a shape complementary to that of the opening, the closure member comprising said insert and a rectangular surrounding frame interlocked with and surrounding the panel, the surrounding frame having an inner periphery and an outer periphery, the panel and surrounding frame having complementary intercalating tongue and groove formations on their outer and inner peripheries respectively, which formations co-operate to cause the surrounding frame and panel to interlock to form the closure member, at least one of the intercalating tongue and groove formations having clearance between the outer edge of each tongue thereof and the associated groove to accommodate swelling of the panel in the surrounding frame, and the panel and surrounding frame being arranged so that when the panel is received in the opening with the closure member in its closed condition, the surrounding frame seats against the inner surface of the outer frame of the door, along the periphery of the opening.

The outer surface of the surrounding frame thus presents an abutment surface for the closure member, for abutting in use against a complementary surface on the outer frame.

The security bars may extend vertically across the opening.

According to another aspect of the invention there is provided a security door for closing a doorway into an area protected by the door on the inside of the doorway, the door comprising an outer frame for closing off the doorway;

door hinge means connected to the outer frame for hingedly mounting the outer frame in the doorway, whereby the door can be pivoted between open and closed conditions;

an opening through the frame for permitting ventilation and viewing between the area protected by the door and the area outside of the doorway;

a plurality of security bars mounted on the frame and extending across the opening to close off the opening to human entry through the opening while permitting said ventilation and viewing;

a closure member for closing off the opening to prevent said ventilation and viewing; and closure member hinge means connected to the closure member whereby the closure member is pivotally mounted on the outer frame and which permits the closure member to be pivoted into the area protected by the door from a closed condition in which it closes off the opening to assume an open condition in which it permits said ventilation and viewing, and to be pivoted from said open condition into said closed condition, the closure member comprising a panel having an outer periphery of a shape complementary to that of the opening and receivable in the opening when the closure member is in its closed condition, and a surrounding frame interlocked with and surrounding the panel, the surrounding frame having an inner periphery and an outer periphery, the panel and its surrounding frame being provided with complementary intercalating tongue and groove formations on their outer and inner peripheries respectively which formations co-operate to cause the surrounding frame and panel to interlock.

The surrounding frame may comprise two or more longitudinally spaced transverse members secured to and interconnected by a pair of laterally spaced longitudinal members.

The closure member hinge means and door hinge means may both be mounted at or adjacent the same side edge of the outer frame.

The door latch means and the closure member latch means may both be locks lockable by removable keys. Instead, they may be in the form of other latch means, such as sliding bolts, chain latches and the like.

The door hinge means and the closure member hinge means may each comprise a plurality of spaced hinges, the hinges being located on the side of the outer frame which faces into the area protected by the door in its closed condition.

The door may be of wood.

The invention will now be described by way of example, with reference to the accompanying diagrammatic drawings, in which.

Figure 1:
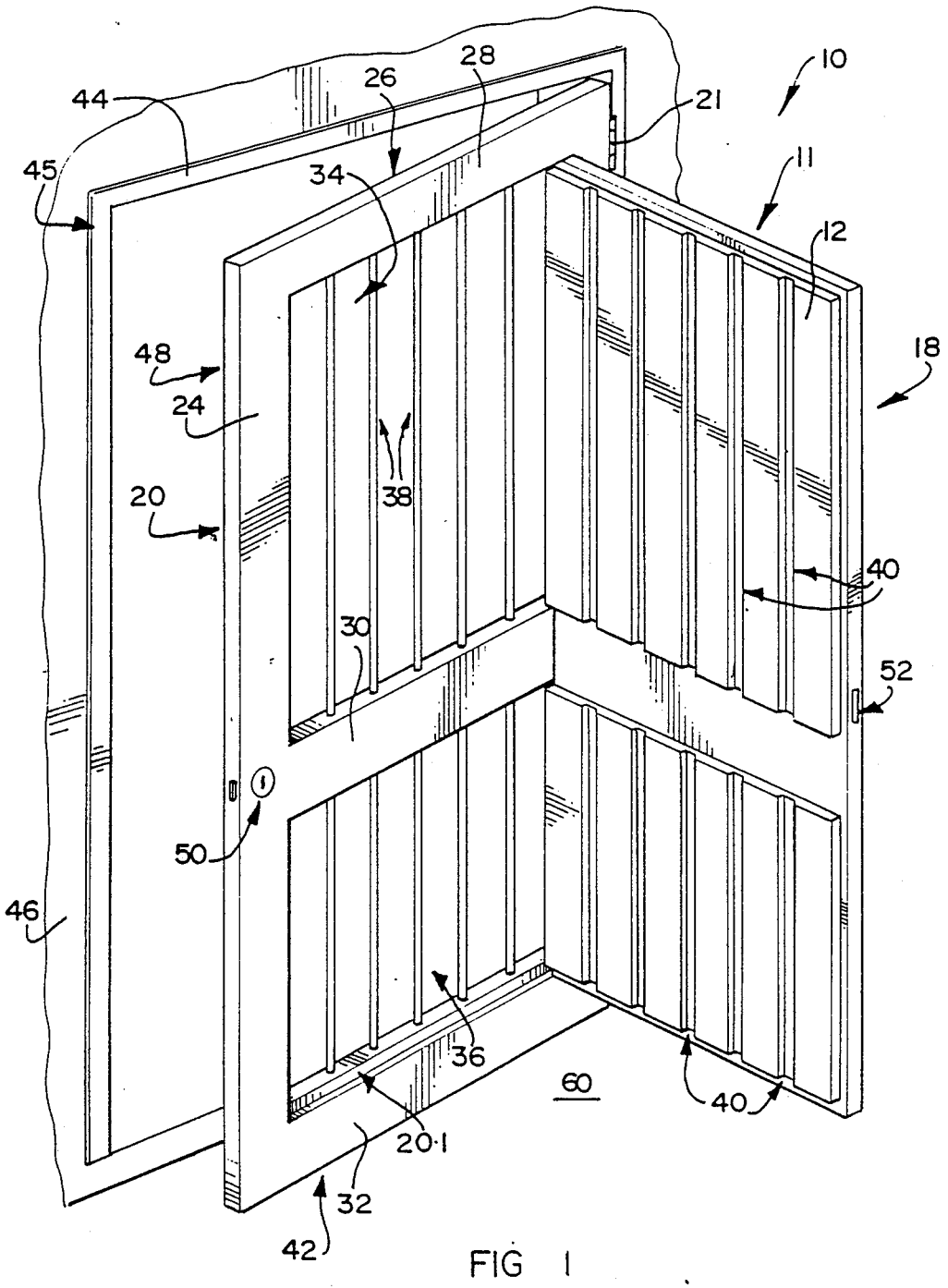
FIG. 1 shows a three-dimensional view of a security door according to the invention mounted on the inside of a doorway.

In the drawings, reference numeral 10 generally indicates a security door according to the invention.

Figure 2:
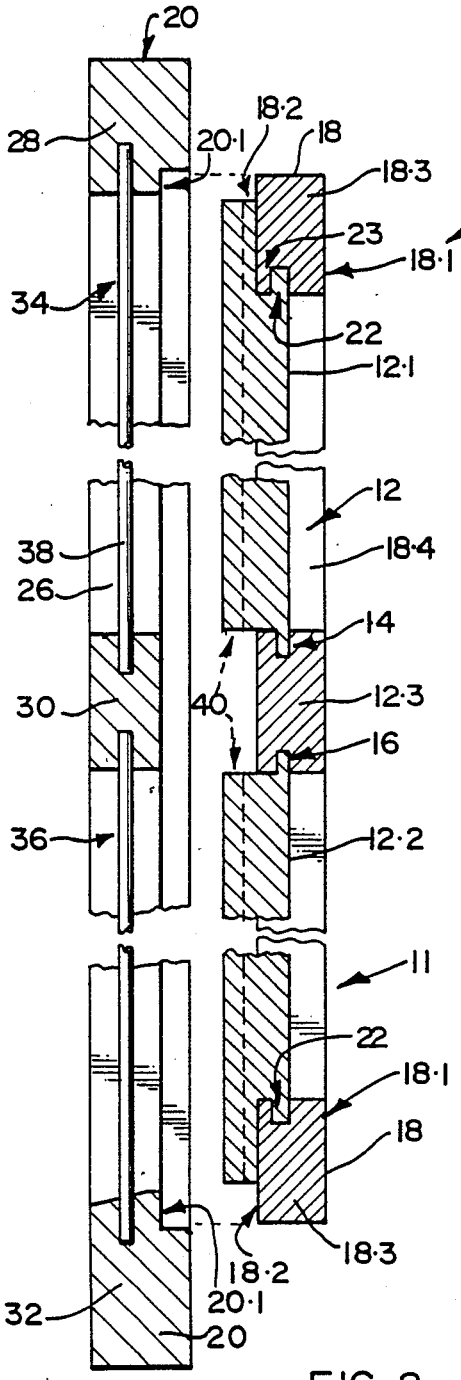
FIG. 2 shows an exploded fragmentary sectional side view of the security door of FIG. 1.
Figure 3:
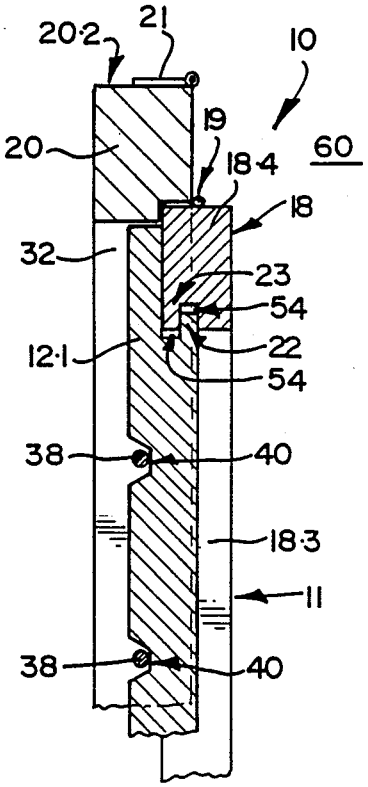
FIG. 3 shows a fragmentary sectional plan view of the security door of FIG. 1 in closed condition.

The door 10 includes a closure member 11 and an outer frame 20, the closure member 11 being hingedly mounted on the outer frame 20. The closure member 11 includes a composite panel 12 comprising an upper portion 12.1 and lower portion 12.2 secured to and interconnected by a transversely extending centre piece 12.3, by means of complementary tongue and groove formations 14 and 16 (FIG. 2). A surrounding frame 18 surrounds the panel 12, the frame having an inner surface 18.1 and an outer surface 18.2, and a pair of vertically spaced hinges 19 (FIG. 3) for hingedly mounting the frame 18 in the outer frame 20. The panel 12 and its surrounding frame 18 are provided with complementary intercalating tongue and groove formations 22 and 23 respectively, which co-operate to cause the surrounding frame 18 and panel 12 to interlock to form the closure member 11, so that the panel 12 projects outwardly beyond the outer surface 18.2 of the surrounding frame 18. The tongue and groove formation 22 of the panel 12 is formed along its outer periphery, and the complementary tongue and groove formation 23 of the surrounding frame 18 is formed along its inner periphery.

The outer surface 18.2 of the surrounding frame 18 presents an abutment surface for the closure member 11, for abutting in use against a complementary surface 20.1 on the outer frame 20 on which the closure member 11 is hingedly mounted in use.

The surrounding frame 18 comprises two vertically spaced transverse members 18.3 secured to and interconnected by a pair of laterally spaced longitudinal members 18.4. The transverse members 18.3 and longitudinal members 18.4 are interconnected at their free ends by adhesively secured mortise joints.

The outer frame 20 comprises a pair of laterally spaced longitudinal members 24 and 26, secured to and interconnected by three vertically spaced transverse members 28, 30 and 32. The outer frame 20 has a pair of openings 34 and 36, the closure member 11 being hingedly mounted on the outer frame 20 to open or close the openings 34 and 36 in use, as desired.

The outer frame 20 has a plurality of longitudinally extending laterally spaced security bars in the form of rods 38 extending across the openings 34 and 36, the free ends of the rods 38 being embedded in the transverse members 28, 30 and 32. The panel 12 is in turn formed with longitudinally extending grooves 40 arranged in use to receive the rods 38 when the closure member 11 is pivoted about its hinge mounting 19 to close off the openings 34 and 36 in the outer frame 20.

The outer frame 20 is in turn hingedly mounted via a pair of vertically spaced hinges 21 in an opening 42 in a built in door frame 44, built into a doorway 45 in a wall 46. The pairs of hinges 19 and 21 are both mounted adjacent the same side edge 20.2 of the outer frame 20, and are located on the side of the outer frame 20 which faces into the area 60 protected by the door 10 in its closed condition. The door 10 is lockable by means of lock 50 to built-in frame 44. The closure member 11 is in turn lockable by means of lock 52 to the outer frame 20. Both locks 50 and 52 have removable keys (not shown). The door 10 may thus remain locked to the built-in frame 44, while the closure member 10 is opened. The door 10 thus allows limited communication with the exterior of a room or enclosure, while simultaneously preventing access into the enclosure by unwanted persons.

It is an advantage of the door 10 of the invention that, due to the fact that the upper and lower portions 12.1, 12.2 of the panel 12 project outwardly beyond the outer surface 18.2 of the surrounding frame 18, they are able to project deeply into the openings 34 and 36 in the outer frame 28, so that the security bars 38 are in turn received deeply into the grooves 40 in the panel 12. Furthermore, the surrounding frame 18 strengthens the panel 12 against distortion and warping, in the case where the panel 12 is of wood, by moisture absorbed by the wood. Also, the intercalating tongue and groove formations 22 and 23 may be caused to interlock with a slight clearance, as shown as 54 in FIG. 3 of the drawings, so as to compensate for expansion of the panel 12 due to heat and/or moisture. The latter two advantages contribute towards a security door 10 which is less prone to jam as a result of expansion caused by heat and/or moisture.

I claim:

1. A security door for closing a doorway into an area protected by the door on the inside of the doorway, the door comprising an outer frame for closing off the doorway;

door hinge means connected to the outer frame for hingedly mounting the outer frame in the doorway, whereby the door can be pivoted between open and closed conditions;

an opening through the outer frame for permitting ventilation and viewing between the area protected by the door and the area outside of the doorway;

a plurality of security bars mounted on the outer frame and extending across the opening to close off the opening to human entry through the opening while permitting said ventilation and viewing;

a closure member for closing off the opening to prevent said ventilation and viewing;

closure member hinge means connected to the closure member whereby the closure member is pivotally mounted on the outer frame and which permits the closure member to be pivoted into the area protected by the door from a closed condition in which it closes off the opening to assume an open condition in which it permits said ventilation and viewing, and to be pivoted from said open condition into said closed condition;

an insert for the opening which insert is provided by the closure member and which insert projects into the opening in the outer frame and occupies said opening when the closure member is in its closed condition;

a plurality of recesses in the form of elongate grooves in the insert for respectively receiving the security bars when the closure member is in its closed condition with the bars at least partially enclosed and concealed therein;

lockable door latch means for locking the outer frame in its closed condition to the doorway; and lockable closure member latch means for locking the closure member in its closed condition to the outer frame.

2. A security door as claimed in claim 1 in which said latch means and said closure member latch means are both locks lockable by removable keys.

3. A security door as claimed in claim 1 wherein the opening is rectangular and said insert is in the form of a rectangular panel having an outer periphery of a shape complementary to that of the opening, the closure member comprising said insert and a rectangular surrounding frame interlocked with and surrounding the panel, the surrounding frame having an inner periphery and an outer periphery, the panel and surrounding frame having complementary intercalating tongue and groove formations on their outer and inner peripheries respectively, which formations co-operate to cause the surrounding frame and panel to interlock to form the closure member at least one of the intercalating tongue and groove formations having clearance between the outer edge of each tongue thereof and the associated groove to accommodate swelling of the panel in the surrounding frame, and the panel and surrounding frame being arranged so that when the panel is received in the opening with the closure member in its closed condition, the surrounding frame seats against the inner surface of the outer frame of the door, along the periphery of the opening.

4. A security door for closing a doorway into an area protected by the door on the inside of the doorway, the door comprising an outer frame for closing off the doorway;

door hinge means connected to the outer frame for hingedly mounting the outer frame in the doorway, whereby the door can be pivoted between open and closed conditions;

an opening through the frame for permitting ventilation and viewing between the area protected by the door and the area outside of the doorway;

a plurality of security bars mounted on the frame and extending across the opening to close off the opening to human entry through the opening while permitting said ventilation and viewing;

a closure member for closing off the opening to prevent said ventilation and viewing; and closure member hinge means connected to the closure member whereby the closure member is pivotally mounted on the outer frame and which permits the closure member to be pivoted into the area protected by the door from a closed condition in which it closes off the opening to assume an open condition in which it permits said ventilation and viewing, and to be pivoted from said open condition into said closed condition; the closure member comprising a panel having an outer periphery of a shape complementary to that of the opening and receivable in the opening when the closure member is in its closed condition, and a surrounding frame interlocked with and surrounding the panel, the surrounding frame having an inner periphery and an outer periphery, the panel and its surrounding frame being provided with complementary intercalating tongue and groove formations on their outer and inner peripheries respectively which formations co-operate to cause the surrounding frame and panel to interlock.

5. A security door as claimed in claim 4, and further including a door latch means for securing said door in said closed condition and a closure member latch means for securing said closure member in said closed condition, in which said door latch means and said closure member latch means are both locks lockable by removable keys.

6. A security door as claimed in claim 1 or claim 4, in which the door hinge means and the closure member hinge means each comprise a plurality of spaced hinges, the hinges being located on the side of the outer frame which faces into the area protected by the door in its closed condition.

7. A security door as claimed in claim 3 or claim 4 wherein the closure member hinge means and door hinge means are both mounted at or adjacent the same side edge of the outer frame.

* * * * *